US009152162B2

(12) United States Patent
Lee

(10) Patent No.: US 9,152,162 B2
(45) Date of Patent: Oct. 6, 2015

(54) CONSTANT VOLTAGE GENERATING CIRCUIT AND CONSTANT VOLTAGE GENERATING METHOD FOR GENERATING A CONSTANT VOLTAGE WITH RESPECT TO A VARIABLE POWER SUPPLY VOLTAGE WITHOUT USING A REGULATOR

(71) Applicant: Samsung Electro-Mechanics Co., Ltd., Suwon-si (KR)

(72) Inventor: Soo Woong Lee, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 296 days.

(21) Appl. No.: 13/797,711

(22) Filed: Mar. 12, 2013

(65) Prior Publication Data

US 2013/0249526 A1 Sep. 26, 2013

(30) Foreign Application Priority Data

Mar. 20, 2012 (KR) ..... 10-2012-0028314

(51) Int. Cl.
*G05F 1/10* (2006.01)
*G05F 3/02* (2006.01)

(52) U.S. Cl.
CPC ..... *G05F 3/02* (2013.01)

(58) Field of Classification Search
CPC ..... G05F 3/02; G05F 5/00
USPC ..... 327/538–541
See application file for complete search history.

(56) References Cited

U.S. PATENT DOCUMENTS 7,282,989 B2 * 10/2007 Byeon ..... 327/541
7,619,402 B1 * 11/2009 Kwong ..... 323/369
7,639,067 B1 12/2009 Perisetty
8,203,379 B2 * 6/2012 Chen et al. ..... 327/538

(Continued)

FOREIGN PATENT DOCUMENTS

JP 11-338560 A 12/1999
JP 2003-510712 A 3/2003

(Continued)

OTHER PUBLICATIONS

KR 10-2012-0028314 Notice of Allowance dated Feb. 10, 2014; 2pgs.

*Primary Examiner* — Kenneth B Wells
(74) *Attorney, Agent, or Firm* — NSIP Law

(57) ABSTRACT

Disclosed herein are a constant voltage generating circuit and a constant voltage generating method. According to an embodiment of the present invention, the constant voltage generating circuit includes a voltage distribution unit performing voltage drop on a variable input power, a reference voltage and register bit generation unit outputting a band gap reference voltage and register bit, a comparison control unit comparing an input voltage dropped in the voltage distribution unit and the band gap reference voltage output from the reference voltage and register bit generation unit, and controlling the reference voltage and register bit generation unit or a constant voltage generation unit in accordance with the compared result, and a constant voltage generation unit receiving the variable input power by an operation of a switch corresponding to the register bit to thereby output a constant voltage, in accordance with the control of the comparison control unit.

19 Claims, 6 Drawing Sheets

(56) References Cited

U.S. PATENT DOCUMENTS

| | | | | |
|---|---|---|---|---|
| 8,461,913 | B2 * | 6/2013 | Garrard et al. | 327/540 |
| 8,803,502 | B2 * | 8/2014 | Lee | 323/297 |

FOREIGN PATENT DOCUMENTS

| | | | |
|---|---|---|---|
| JP | 2004-192465 | A | 7/2004 |
| JP | 2006-067678 | A | 3/2006 |

* cited by examiner

- PRIOR ART -

CONSTANT VOLTAGE GENERATING CIRCUIT AND CONSTANT VOLTAGE GENERATING METHOD FOR GENERATING A CONSTANT VOLTAGE WITH RESPECT TO A VARIABLE POWER SUPPLY VOLTAGE WITHOUT USING A REGULATOR

CROSS REFERENCE(S) TO RELATED APPLICATIONS

This application claims the benefit under 35 U.S.C. Section 119 of Korean Patent Application Serial No. 10-2012-0028314, entitled "Constant Voltage Generating Circuit and Constant Voltage Generating Method" filed on Mar. 20, 2012, which is hereby incorporated by reference in its entirety into this application.

BACKGROUND OF THE INVENTION

1. Technical Field

The present invention relates to a constant voltage generating circuit and a constant voltage generating method, and more particularly, to a constant voltage generating circuit which generates a constant voltage with respect to a variable power supply voltage without using a regulator, and a constant voltage generating method.

2. Description of the Related Art

One of the items determining the design of electronic circuit systems is a power supply voltage level. Even in the same application, an optimized power supply voltage level may differ for each system. Accordingly, there are many cases in which an integrated circuit used in the system is required to be designed based on a variable power supply voltage. When a power supply voltage varies, a voltage and a current of each node of the circuit may vary. These variations may cause many problems in linearity of the circuit, noise, and management of power consumption.

To generate a power supply voltage of a constant level with respect to a variable power, a regulator may be frequently used. However, in order to output a constant voltage using a regulator, additional circuits such as a Band Gap Reference (BGR), a Low Drop Output (LDO), and the like other than the regulator may be required. A regulator output voltage with superior performance is obtained when a regulator system is constituted using the additional circuit; however, the volume of the circuit and power consumption may be increased.

FIG. 6 shows a regulator system having a general structure in the related art. When a width of a variable power is large, or an input power supply voltage is significantly larger than a final regulator output, a primary regulator 1 may be used as shown in FIG. 6. A variation ratio of an output voltage of the primary regulator 1 is at least 10% or larger, and therefore, an accurate output voltage may be obtained through an LDO that is a secondary regulator 2. Accuracy of the voltage that is output by the LDO 2 depends on the accuracy of a BGR 3. This is because the LDO 2 multiplies a BGR voltage received as an input to thereby output an output voltage. Here, the primary regulator 1, the BGR 3, and the secondary regulator 2 which are used to obtain a constant output voltage in FIG. 6 have superior performance; however, each block of the primary regulator 1, the BGR 3, and the secondary regulator 2 is heavy, so that problems in power consumption and a size may be generated in a circuit requiring low power and miniaturization.

RELATED ART DOCUMENT

Patent Documents (Patent Document 1) U.S. Patent Publication No. 7639067 (Dec. 29, 2009)

(Patent Document 2) U.S. Patent Publication No. 7619402 (Nov. 17, 2009)

SUMMARY OF THE INVENTION

An object of the present invention is to provide a constant voltage generating circuit which may output a constant voltage with respect to a variable power supply voltage by minimizing the number of other additional circuits without using a regulator, and a constant voltage generating method.

That is, an object of the present invention is to provide a circuit which may output a constant power supply voltage by constituting a simpler system as much as possible without using a heavy regulator of the related art.

According to a first exemplary embodiment of the present invention, there is provided a constant voltage generating circuit, including: a voltage distribution unit performing voltage drop on a variable input power in accordance with a preset ratio; a reference voltage and register bit generation unit outputting a band gap reference voltage and register bit in accordance with control of a comparison control unit; the comparison control unit comparing an input voltage dropped in the voltage distribution unit and the band gap reference voltage output from the reference voltage and register bit generation unit, and controlling the reference voltage and register bit generation unit or a constant voltage generation unit in accordance with the compared result; and a constant voltage generation unit receiving the variable input power by an operation of a switch corresponding to the register bit to thereby output a constant voltage, in accordance with the control of the comparison control unit.

In this instance, the voltage distribution unit may perform the voltage drop on the variable input power in accordance with the preset ratio using a resistance distributor.

In addition, the reference voltage and register bit generation unit may include a reference voltage generation unit which is formed with a plurality of band gap resistors connected in series, and which generates the band gap reference voltage distributed in accordance with a switch operation of a reference voltage and register bit switch unit; and the reference voltage and register bit switch unit in which each of a plurality of switches connected to the plurality of band gap resistors is connected to a register having a register bit value, and which outputs the register bit of the register connected and the band gap reference voltage, by the operation of the switch in accordance with the control of the comparison control unit.

In this instance, the reference voltage and register bit switch unit may output the register bit of the register connected and the band gap reference voltage, by the operation of the switch corresponding to register bit in accordance with a down sweep control or an up sweep control of the register bit of the comparison control unit.

In addition, the comparison control unit may include a comparator comparing and outputting the input voltage dropped in the voltage distribution unit and the band gap reference voltage output from the reference voltage and register bit generation unit, and a controller performing a sweep control on a switch of the reference voltage and register bit generation unit when an output of the comparator is not a scheduled signal so that the next band gap reference voltage and the next register bit are output, and controlling the constant voltage generation unit when the output is the scheduled signal so that the constant voltage is output.

Here, the controller performs the down sweep control of the register bit on the reference voltage and register bit generation unit when the output of the comparator is a low signal, and stops the down sweep control and turns on a switch of the constant voltage generation unit corresponding to the register bit output from the reference voltage and register bit generation unit to thereby output the constant voltage when the output of the comparator is a high signal.

Further, the controller may perform the up sweep control of the register bit on the reference voltage and register bit generation unit when the output of the comparator is a high signal, and stop the up sweep control and turns on a switch of the constant voltage generation unit corresponding to the register bit output from the reference voltage and register bit generation unit to thereby output the constant voltage when the output of the comparator is a low signal.

Also, the constant voltage generation unit may include a variable distribution switch unit which includes a plurality of switches, and in which a turn-on operation of a switch corresponding to the register bit output from the reference voltage and register bit generation unit is performed by the control of the comparison control unit; and a variable distribution unit which receives the variable input power, and performs variable distribution on the received variable input power in accordance with the turn-on operation of the variable distribution switch unit by the control of the comparison control unit to thereby output the constant voltage.

Furthermore, the variable distribution unit may be formed with series connection of a reference resistor and each of a plurality of voltage dividing branch resistors connected in parallel to each other and connected in series to each switch of the variable distribution switch unit, and perform voltage distribution on the variable input power in accordance with the voltage dividing branch resistor by the turn-on operation of the variable distribution switch unit to thereby output the constant voltage.

According to a second exemplary embodiment of the present invention, there is provided a constant voltage generating method, including: a voltage dropping step of performing voltage drop on a variable input power in accordance with a preset ratio; a reference voltage and register bit outputting step of outputting a band gap reference voltage and register bit; a comparison controlling step of comparing an input voltage on which the voltage drop is performed and the output band gap reference voltage, and feeding back to the reference voltage and register bit outputting step in accordance with a result of the comparison to thereby control the next band gap reference voltage and register bit to be output, or proceeding to the next step to thereby control a constant voltage to be generated; and a constant voltage outputting step of receiving the variable input power by an operation of a switch corresponding to the register bit output from the reference voltage and register bit outputting step in accordance with a control of the comparison controlling step to thereby output the constant voltage.

Here, the reference voltage and register bit outputting step may include an initial step of outputting the band gap reference voltage and register bit in accordance with an operation of a switch corresponding to the highest or the lowest register bit in a manner such that each of a plurality of switches connected to a plurality of band gap resistors is connected to a register having a register bit value; and a feedback progressing step of outputting the band gap reference voltage on distributed and the register bit, in accordance with an operation of a switch corresponding to the next register bit by the feedback of the comparison controlling step.

In addition, the feedback progressing step outputs the next band gap reference voltage and register bit by the operation of the switch in accordance with a down sweep control or an up sweep control of the register bit.

Also, the comparison controlling step may turn back to the feedback progressing step to perform a down sweep control of the register bit when the result of the comparison is a low signal, and stop the down sweep control to thereby control a turn-on operation of the switch corresponding to the register bit output from the reference voltage and register bit outputting step in the constant voltage outputting step when the result of the comparison is a high signal.

Further, the comparison controlling step may turn back to the feedback progressing step to perform an up sweep control of the register bit when the result of the comparing is a high signal, and stop the up sweep control to thereby control a turn-on operation of the switch corresponding to the register bit output from the reference voltage and register bit outputting step in the constant voltage outputting step when the result is a low signal.

Further, the constant voltage outputting step may receive the variable input power, perform variable distribution on the variable input power by turning on the switch corresponding to the register bit output from the reference voltage and register bit outputting step in accordance with the control of the comparison controlling step, and output the constant voltage.

In addition, the constant voltage outputting step may output the constant voltage in accordance with voltage distribution of a reference resistor and a plurality of voltage dividing branch resistors which are connected in series to the reference resistor and connected in parallel to each other, wherein the variable distribution on the variable input power is performed by turn-on of a switch corresponding to the register bit output from the reference voltage and register bit outputting step, from among switches connected to each of the plurality of voltage dividing branch resistors, in accordance with the control of the comparison controlling step.

DESCRIPTION OF THE PREFERRED EMBODIMENTS

Figure 1:
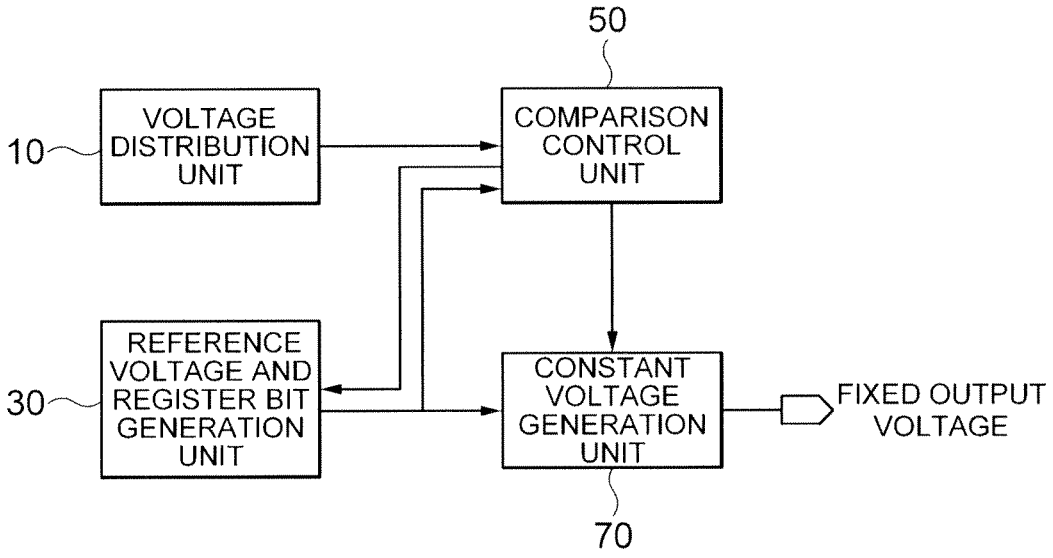
FIG. 1 is a schematic block diagram illustrating a constant voltage generating circuit according to an exemplary embodiment of the present invention.

Exemplary embodiments of the present invention for accomplishing the above-mentioned objects will be described with reference to the accompanying drawings. In describing exemplary embodiments of the present invention, the same reference numerals will be used to describe the same components and an additional description that is overlapped or allow the meaning of the present invention to be restrictively interpreted will be omitted.

In the specification, it will be understood that unless a term such as 'directly' is not used in a connection, coupling, or disposition relationship between one component and another component, one component may be 'directly connected to', 'directly coupled to' or 'directly disposed to' another element or be connected to, coupled to, or disposed to another element, having the other element intervening therebetween. In addition, this may also be applied to terms including the meaning of contact such as 'on', 'above', 'below', 'under', or the like. In the case in which a standard element is upset or is changed in a direction, terms related to a direction may be interpreted to including a relative direction concept.

Although a singular form is used in the present description, it may include a plural form as long as it is opposite to the concept of the present invention and is not contradictory in view of interpretation or is used as clearly different meaning. It should be understood that "include", "have", "comprise", "be configured to include", and the like, used in the present description do not exclude presence or addition of one or more other characteristic, component, or a combination thereof.

First, a constant voltage generating circuit according to a first embodiment of the present invention will be described in detail with reference the accompanying drawings. In this instance, like reference numerals denote like elements throughout the drawings.

Figure 2:
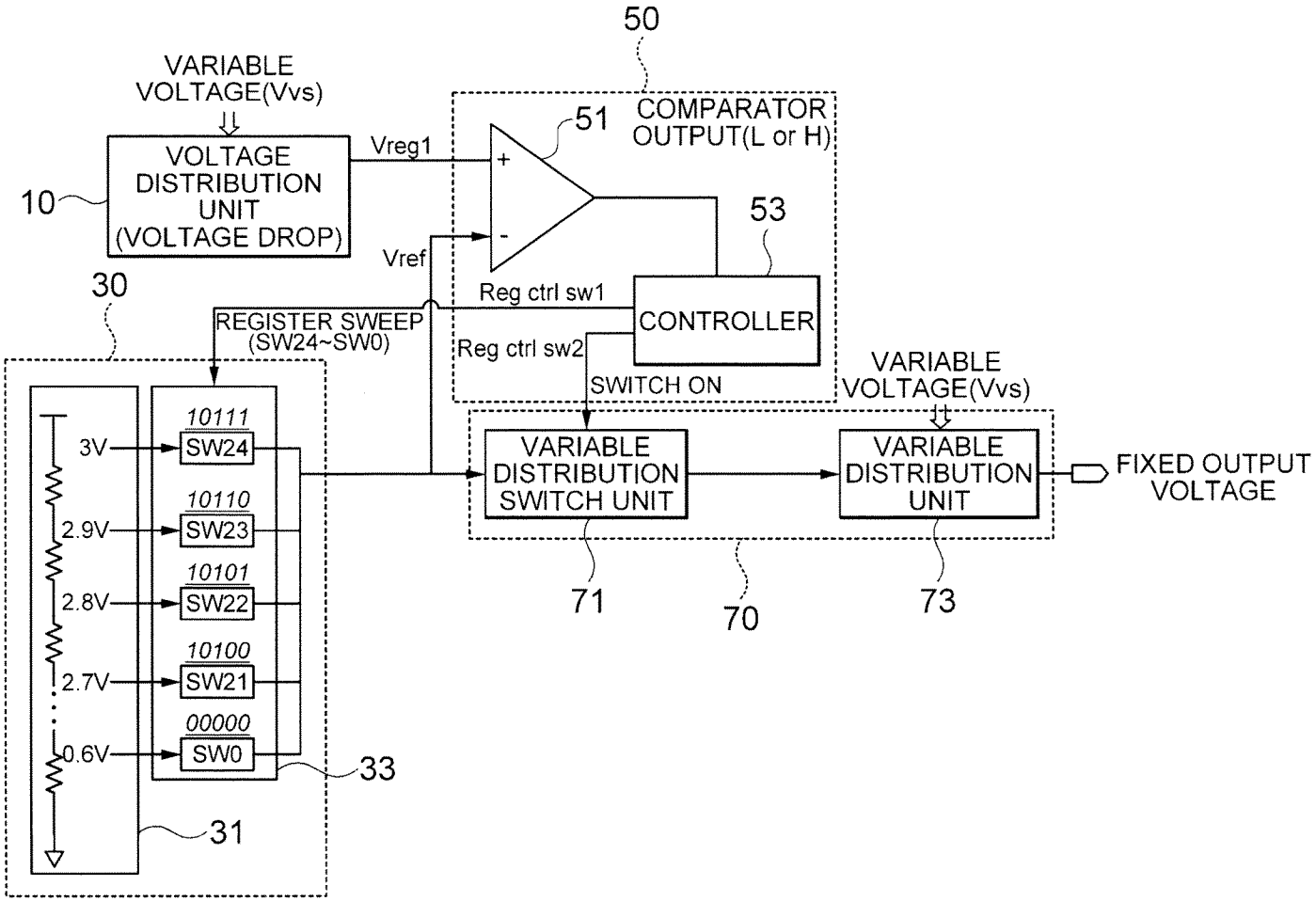
FIG. 2 is a schematic circuit block diagram illustrating a constant voltage generating circuit according to another exemplary embodiment of the present invention.
Figure 3:
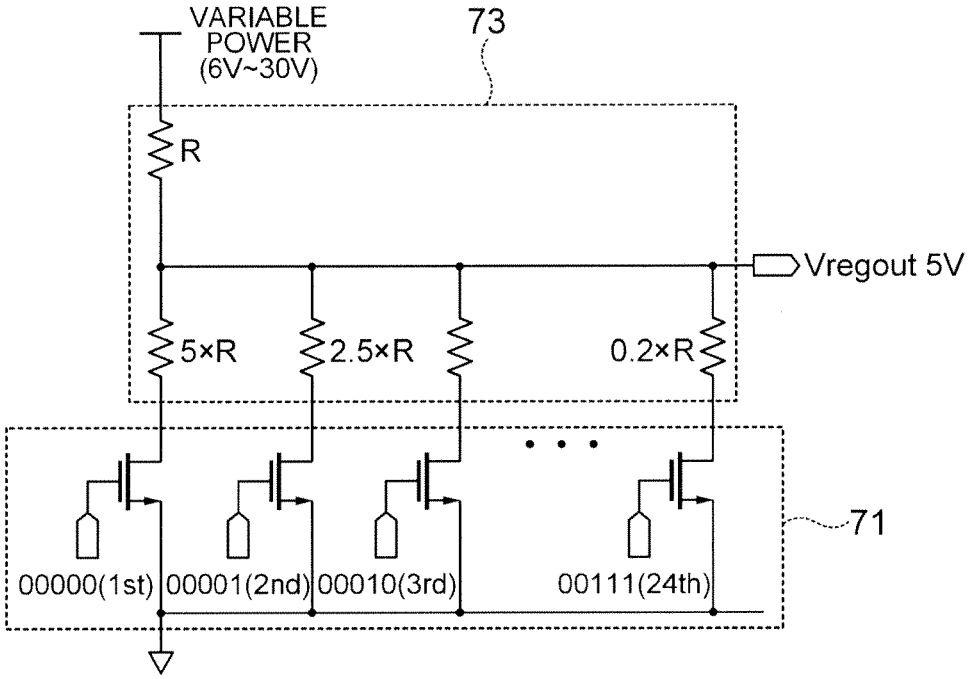
FIG. 3 is a schematic circuit diagram illustrating a constant voltage generation unit according to an exemplary embodiment of the present invention.

FIG. 1 is a schematic block diagram illustrating a constant voltage generating circuit according to an exemplary embodiment of the present invention, FIG. 2 is a schematic circuit block diagram illustrating a constant voltage generating circuit according to another exemplary embodiment of the present invention, FIG. 3 is a schematic circuit diagram illustrating a constant voltage generation unit according to an exemplary embodiment of the present invention, and FIG. 4 is a graph illustrating a constant output voltage of a constant voltage generating circuit according to an exemplary embodiment of the present invention.

The constant voltage generating circuit according to an embodiment of the present invention may be very useful for a case in which a range of a variable voltage is large, and a voltage in which LDMOS can be used is high.

Referring to FIGS. 1 and/or 2, the constant voltage generating circuit according to an embodiment includes a voltage distribution unit 10, a reference voltage and register bit generation unit 30, a comparison control unit 50, and a constant voltage generation unit 70.

In FIGS. 1 and/or 2, the voltage distribution unit 10 performs voltage drop on a variable input power in accordance with a preset ratio.

Referring to FIG. 2, more specifically, according to an embodiment, the voltage distribution unit 10 may perform voltage drop on the variable input power in accordance with the preset ratio using a resistance distributor (not shown). A ratio of the voltage drop may be adjusted and fixed in advance by setting. In FIG. 2, it is assumed that the variable input power that is input to the voltage distribution unit 10 is 6V to 30V. In this instance, it is assumed that a voltage drop output (Vreg1) through the voltage distribution unit 10 is 1/10 of the variable input power (Vvs). For example, when the variable input power is 6V to 30V, the output voltage (Vreg1) through the voltage distribution unit 10 is 0.6 to 3V. When the input power supply voltage is reduced down to 1/10 to be output, there is no need to use a high-voltage transistor. An LDMOS type high-voltage transistor is frequently used in a transistor of 5V or greater, which may differ depending on processes; however, a size of the high-voltage transistor is much larger than that of a general transistor, and therefore, a size of the circuit may be greatly reduced without using the LDMOS. In addition, in the high-voltage transistor, there are many cases in which a parasitic component is large and modeling is not accurate in comparison with the general transistor. Therefore, when the voltage distribution unit 10 reduces the input power supply voltage to, for example, 1/10 or to another voltage drop ratio to be output, instability of a circuit may be reduced.

Next, in FIGS. 1 and/or 2, the reference voltage and register bit generation unit 30 will be described. The reference voltage and register bit generation unit 30 outputs register bit and a band gap reference voltage corresponding to the register bit in accordance with a control of the comparison control unit 50.

Referring to FIG. 2, the reference voltage and register bit generation unit 30 will be described in more detail. According to an embodiment, the reference voltage and register bit generation unit 30 may include a reference voltage generation unit 31 and a reference voltage and register bit switch unit 33.

The reference voltage generation unit 31 of FIG. 2 is connected in series to a plurality of band gap resistors. In this instance, the reference voltage generation unit 31 of FIG. 2 may generate a band gap reference voltage which is subjected to voltage distribution in accordance with a switch operation of the reference voltage and register bit switch unit 33 connected to the plurality of band gap resistors.

Referring to FIG. 2, the reference voltage generation unit 31 may generate a DC voltage of 3V to 0.6V at an interval of, for example, 0.1V using a Band Gap Reference (BGR). In this instance, the band gap reference voltages that can be generated in the reference voltage generation unit 31 and a band gap therebetween may differ depending on the settings. For example, when it is assumed that the voltage is dropped to 1/10 in the voltage distribution unit 10 when the variable input voltage is 30V to 6V, a DC voltage of 3V to 0.6V may be generated at an interval of 0.1V in a range of the band gap reference voltage for comparison with the input voltage which is subjected to a voltage drop. The range of the band gap reference voltage may be determined in accordance with an allowable range of the variable input voltage and voltage drop ability of the voltage distribution unit 10 according to the allowable range.

Subsequently, in the reference voltage and register bit switch unit 33 of FIG. 2, each of a plurality of switches connected to a plurality of band gap resistors is connected to a register having a register bit value. In this instance, the reference voltage and register bit switch unit 33 may output register bit of the register connected by operations of the switches (see, SW0 to sw24 of FIG. 2) in accordance with a control of the comparison control unit 50, and output the band gap reference voltage. That is, when turning on a switch to be controlled by a controller 53 of FIG. 2 or a switch corresponding to the register bit to be controlled, the band gap reference voltage is generated and output through the band gap resistor to which a corresponding switch is connected, and the register connected to the corresponding switch is turned on, so that a register bit value of the corresponding register is output together. In this instance, the output band gap reference voltage may be input to an inverse terminal of a comparator 51 of FIG. 2, and the band gap reference voltage Vref which is input to the inverse terminal of the comparator 51 and the variable voltage Vreg1 which is input to a non-inverse terminal of the comparator 51 and is subjected to voltage drop are compared and output to a high or low signal through the comparator 51. For example, according to an embodiment, when the low signal is output from the comparator 51, a signal controlling the reference voltage and register bit switch unit 33 is output from the controller 53, and the next band gap reference voltage and register bit are output in the reference voltage and register bit switch unit 33. According to an embodiment, when the high signal is output from the comparator 51, a sweep control of the register bit is stopped in the reference voltage and the register bit switch unit 33 in accordance with a control signal output from the controller 53, so that the band gap reference voltage and the register bit in accordance with a previous register bit state are output, a variable distribution switch unit 71 of FIG. 3 is controlled, and a switch of the variable distribution switch unit 71 corresponding to the register bit output from the reference voltage and register bit switch unit 33 is turned on. That is, according to an embodiment, when an output of the comparator 51 is not a scheduled signal for generating a constant voltage, the next band gap reference voltage and register bit signal is output in the reference voltage and register bit switch unit 33 in accordance with a control signal of the controller 53. In addition, when the output of the comparator 51 is the scheduled signal for generating the constant voltage, the sweep control of the controller 53 for outputting the next band gap reference voltage and register bit is stopped in the reference voltage and register bit switch unit 33. At the same time, the switch of the variable distribution switch unit 71 corresponding to the register bit which are output from the reference voltage and register bit switch unit 33 and transmitted to the variable distribution switch unit 71 of FIG. 3 is turned on in accordance with a control of the controller 53.

In this instance, according to an embodiment, operations of the reference voltage and register bit switch unit 33 will be described. An on-operation is performed on the switch of the reference voltage and register bit switch unit 33 corresponding to register bit in accordance with a down sweep control or an up sweep control of the register bit of the comparison control unit 50. In this instance, the reference voltage and register bit switch unit 33 may output a band gap reference voltage in accordance with voltage distribution of a plurality of resistors of the reference voltage generation unit 31, which are connected in series, and a register connected to a corresponding switch performing the on-operation is turned on to thereby output the register bit.

Next, in FIGS. 1 and/or 2, the comparison control unit 50 will be described.

The comparison control unit 50 compares the input voltage dropped in the voltage distribution unit 10 and the band gap reference voltage output from the reference voltage and register bit generation unit 30. In addition, the comparison control unit 50 controls the reference voltage and register bit generation unit 30 or the constant voltage generation unit 70 in accordance with the compared result. In this instance, the comparison control unit 50 determines whether the output of the comparator 51 of FIG. 2 is the scheduled signal for generating the constant voltage, and controls the reference voltage and register bit generation unit 30 when the output is not the scheduled signal so that the next band gap reference voltage and register bit are output. In addition, the comparison control unit 50 controls the reference voltage and register bit generation unit 30 when the output is the scheduled signal so that the constant voltage is output from the constant voltage generation unit 70.

Referring to FIG. 2, the comparison control unit 50 will be described in detail. According to an embodiment, the comparison control unit 50 may include the comparator 51 and the controller 53. In this instance, the comparator 51 of FIG. 2 compares and outputs the input voltage dropped in the voltage distribution unit 10 and the band gap reference voltage output from the reference voltage and register bit generation unit 30.

In this instance, when the output of the comparator 51 is not the scheduled signal for generating the constant voltage, the controller 53 of FIG. 2 may perform a sweep control on the switch of the reference voltage and register bit generation unit 30 so that the next band gap reference voltage and the register bit are output. In addition, when the output of the comparator 51 is the scheduled signal for generating the constant voltage, the controller 53 may control the constant voltage generation unit 70 so that the constant voltage is output. The controller 53 controls the constant voltage generation unit 70, and at the same time, stops the sweep control with respect to the reference voltage and register bit generation unit 30. Here, the "sweep" of the present specification denotes sequential changes, for example, denotes changes so as to be sequentially reduced or increased from the highest or the lowest stage. In the present embodiment, the register bits are sequentially reduced or increased from the highest or lowest stage in accordance with the sweep control, and a switch of the reference voltage and register bit generation unit 30 or a register which corresponds to corresponding register bit may be controlled.

Figure 5A:
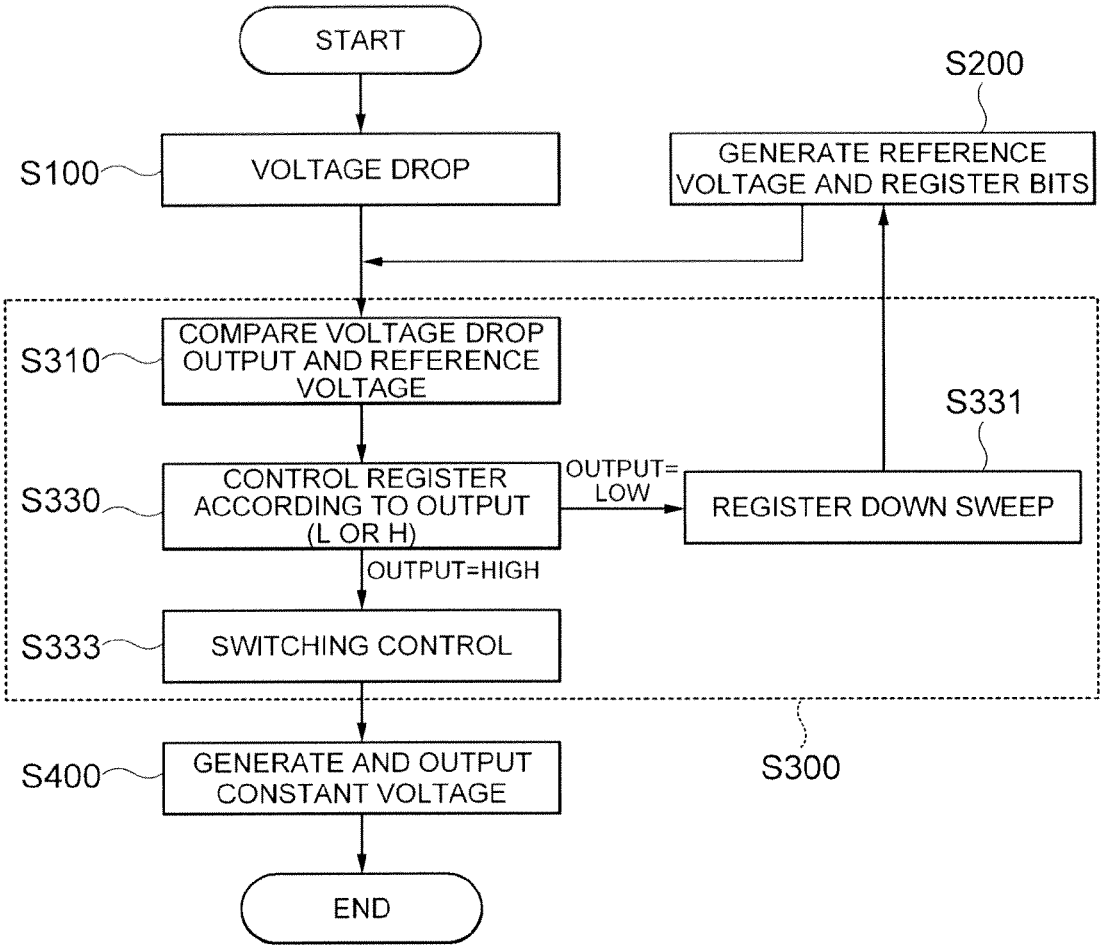
FIGS. 5A and 5B are flowcharts schematically illustrating a constant voltage generating method according to another exemplary embodiment of the present invention.

More specifically, although not directly shown in FIG. 2, referring to FIG. 5A, according to an embodiment, the controller 53 may perform a down sweep control of the register bit with respect to the reference voltage and register bit generation unit 30 when the output of the comparator 51 is a low signal. In this instance, the low signal output from the comparator 51 may not be the scheduled signal for generating the constant voltage. In addition, when the output of the comparator 51 is a high signal, the controller 53 stops the down sweep control with respect to the reference voltage and register bit generation unit 30, and turns on a switch of the constant voltage generation unit 70 corresponding to the register bit output from the reference voltage and register bit generation unit 30, for example, a switch of the variable distribution switch unit 71 of FIG. 3 so that the constant voltage is output. In this instance, the high signal output from the comparator 51 may be the scheduled signal for generating the constant voltage. Even when the down sweep control with respect to the reference voltage and register bit generation unit 30 is stopped, an output of the band gap reference voltage and register bit, which is in a previous state, may be maintained in the reference voltage and register bit generation unit 30. That is, when the down sweep control is stopped, the register bit which is subjected to the down sweep control is fixed, and the output of the band gap reference voltage and register bit may be fixed in accordance with fixation of the on-operation of the switch of the reference voltage and register bit generation unit 30 due to the fixation of the register bit. In this instance, the register bit output from the reference voltage and register bit generation unit 30 may be transmitted to the variable distribution switch unit 71 of FIG. 3, and the switch of the variable distribution switch unit 71 corresponding to the register bit may be turned on in accordance with the control of the controller 53, and therefore the constant voltage from the variable input voltage may be generated. In the present embodiment, when an inverse comparator is provided instead of the comparator 51 of FIG. 2, a low signal output of the inverse comparator may be the scheduled signal for generating the constant voltage.

Figure 5B:
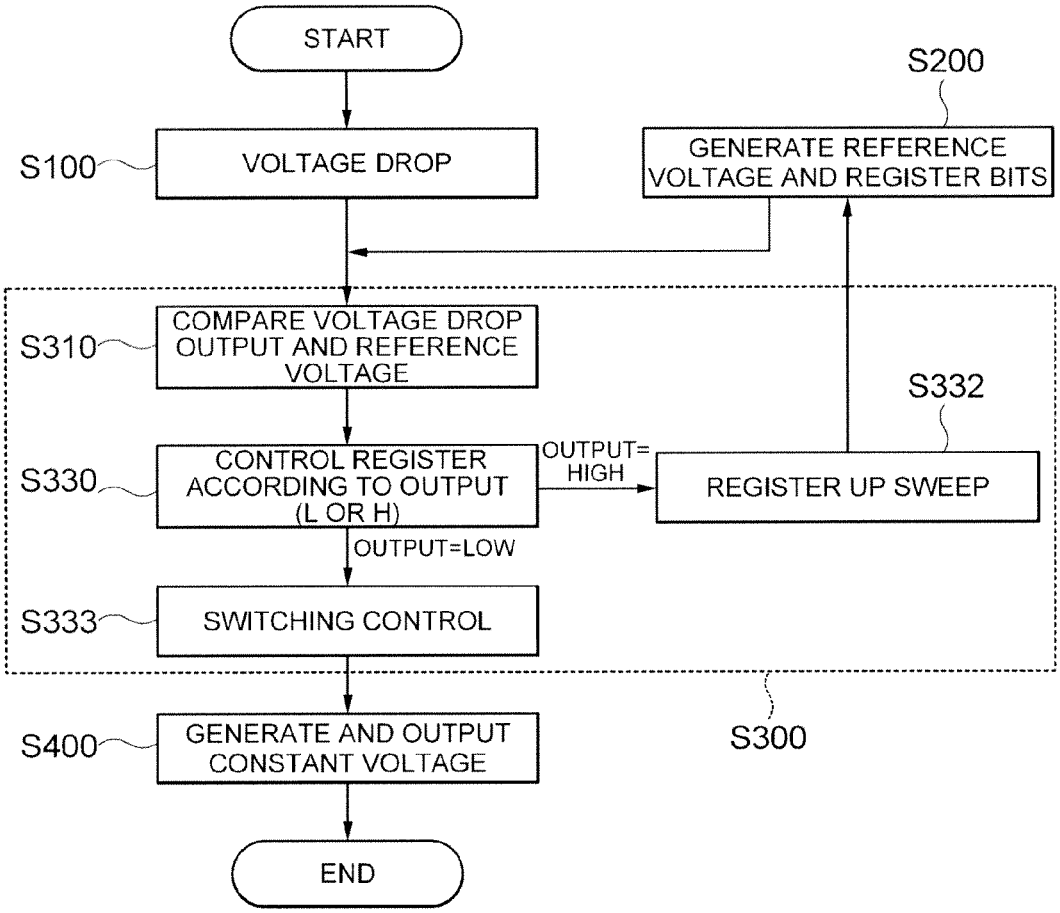
Figure 6:
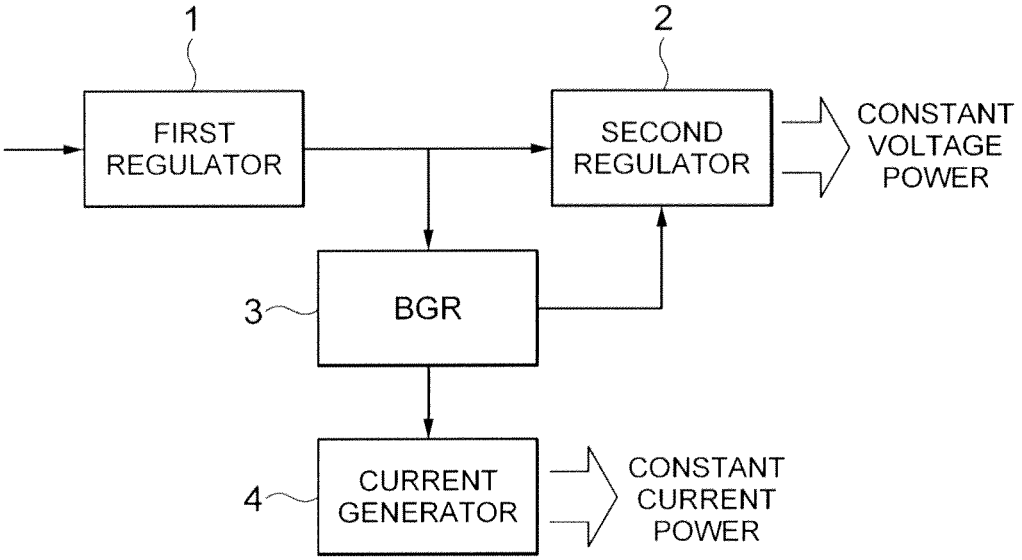
FIG. 6 is a block diagram illustrating a constant voltage and a constant current generating circuit with a general structure.

Alternatively, although not directly shown, referring to FIG. 5B, according to another embodiment, the controller 53 performs an up sweep control of the register bit with respect to the reference voltage and register bit generation unit 30 when the output of the comparator 51 is a high signal. In addition, when the output of the comparator 51 is a low signal, the controller 53 stops the down sweep control with respect to the reference voltage and register bit generation unit 30, and turns on a switch unit of the constant voltage generation unit 70 to which the output of the register bit of the reference voltage and register bit generation unit 30 is transmitted, for example, the variable distribution switch unit 71 of FIG. 3 so that the constant voltage is output. In this instance, the low signal output from the comparator 51 may be the scheduled signal for generating the constant voltage, and the high signal may not be the scheduled signal. In the present embodiment, the low output signal of the comparator 51 has been described as the scheduled signal for generating the constant voltage; however, by adding an inverter (not shown) to a rear end of the comparator 51, a signal input to the controller 53 may be the scheduled signal for generating the constant voltage when the signal is the high signal. Alternatively, by providing an inverse comparator (not shown) in which the band gap reference voltage is input to a non-inverse terminal and the input signal which is subjected to voltage drop is input to the inverse terminal, a high signal of the inverse comparator may be the scheduled signal for generating the constant voltage.

Subsequently, in FIGS. 1 and/or 2, the constant voltage generation unit 70 will be described in detail.

The constant voltage generation unit 70 receives a variable input power by an operation of a switch corresponding to the register bit, and outputs a constant voltage in accordance with a control of the comparison control unit 50.

In this instance, the constant voltage generation unit 70 will be described in detail with reference to FIG. 3. According to an embodiment, the constant voltage generation unit 70 may include the variable distribution switch unit 71 and a variable distribution unit 73.

In FIG. 3, the variable distribution switch unit 71 includes a plurality of switches, and turns on a switch corresponding to the register bit output from the reference voltage and register bit generation unit 30 in accordance with a control of the comparison control unit 50. In this instance, a control signal of the comparison control unit 50 is a control signal for generating the constant voltage, and, according to an embodiment, a sweep control with respect to the reference voltage and register bit generation unit 30 may be stopped in accordance with the control signal for generating the constant voltage of the comparison control unit 50. When the sweep control with respect to the reference voltage and register bit generation unit 30 is stopped, a switching operation of the reference voltage and register bit switch unit 33 is not changed, and therefore the band gap reference voltage and register bit which were previously output may be fixed and output. In this instance, the register bit output from the reference voltage and register bit switch unit 33 are transmitted to the variable distribution switch unit 71, and a switch of the variable distribution switch unit 71 corresponding to register bit may be turned on in accordance with the control signal of the comparison control unit 50, specifically, the controller 53.

In addition, the variable distribution unit 73 of FIG. 3 receives a variable input power, and performs variable distribution on the variable input power which is input in accordance with a turning-on operation of the variable distribution switch unit 71 in accordance with the control of the comparison control unit 50 to thereby output the constant voltage.

In this instance, according to another embodiment, the variable distribution unit 73 is formed with series connection of a reference resistor (R) and each of a plurality of voltage dividing branch resistors connected in parallel to each other. Each of a plurality of voltage dividing branch resistors is connected in series to each switch of the variable distribution switch unit 71. The variable distribution unit 73 performs voltage distribution on the variable input power by the turning-on operation of the variable distribution switch unit 71 in accordance with the voltage dividing branch resistors to thereby output the constant voltage. In FIG. 3, the voltage dividing branch resistors are shown as 5×R, 2.5×R, . . . , 0.2×R.

Referring to FIGS. 2 and 3, for example, it is assumed when a variable power 6V is input, and a final constant voltage output of 5V is obtained. In FIG. 2, an output (Vreg1) of the voltage distribution unit 10 is 0.6V, and the output is compared with a Vref voltage that is the band gap reference voltage in the comparator 51. The output of the comparator 51 is output as a low signal or a high signal. In this instance, it is assumed that the high signal input to the controller 53 is the scheduled signal for generating the constant voltage. When the low signal is input to the controller 53, the controller 53 performs a down sweep so that a Vref signal that is the band gap reference voltage is continuously changed per 0.1V. In addition, when the high signal is input to the controller 53, the controller 53 stops the down sweep control which reduces the band gap reference voltage per 0.1V. When the down sweep control is stopped, a switching change in the reference voltage and register bit switch unit 33 of FIG. 2 does not occur, and therefore, the band gap reference voltage and register bit, which are previously output, are output, and the output register bit are transmitted to the constant voltage generation unit 70, for example, the variable distribution switch unit 71 of FIG. 3. In this instance, at the same time, the controller 53 controls in a manner such that a switch of the variable distribution switch unit 71 of FIG. 3 corresponding to the register bit output from the reference voltage and register bit switch unit 33 is turned on.

Referring to FIG. 3, by adjusting a resistance value of a denominator of the variable distribution unit 73 through a 5-bit register which is output from the reference voltage and register bit generation unit 30, for example, the reference voltage and the register bit switch unit 33 of FIG. 2, a constant output of 5V may be obtained. In other words, so that an input voltage level may be determined through a comparison between the band gap reference voltage (Vref) and a voltage (Vreg1), which is input and is subjected to voltage drop, and at this time, a register may generate a 5V output, a switch corresponding to register bit of the variable distribution switch unit 71 having a register bit value 00000 is turned on, and a voltage dividing branch resistor 5×R value of the variable distribution unit 73 is selected, thereby obtaining a 5V output as follows.

$$V_{regout} = \frac{5R}{5R + R} \times 30V = 5V$$

When 30V that is the largest power supply voltage from an assumed variable input power range is supplied, a register bit value 10111 is transmitted to the variable distribution switch unit 71, and a switch corresponding to corresponding register bit is operated, and 0.2×R among the voltage dividing branch resistors of the variable distribution unit 73 is selected, thereby finally outputting 5V as follows.

$$V_{regout} = \frac{0.2R}{0.2R + R} \times 30V = 5V$$

In the above, the band gap reference voltage which is changed per 0.1V using the 5-bit register has been described; however, 5V output voltage may be obtained as a more accurate band gap reference voltage when a register is added.

Figure 4A:
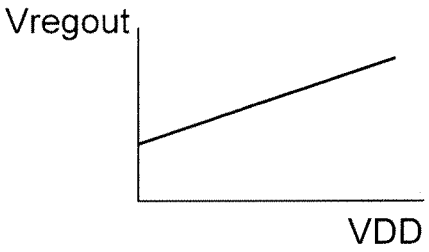
FIGS. 4A and 4B are graphs illustrating a constant output voltage of a constant voltage generating circuit according to an exemplary embodiment of the present invention.
Figure 4B:
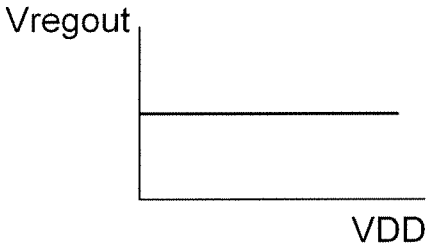

In FIG. 4, a graph of a constant output voltage of a constant voltage generating circuit is shown. In FIG. 4A, an output voltage is changed in accordance with a variable input voltage when the constant voltage generating circuit according to the present invention is not applied, and in FIG. 4B, a constant output voltage is shown by applying the constant voltage generating circuit according to the present invention.

As shown in FIG. 4B, according to an embodiment of the present invention, even though the variable input power supply voltage differs, a circuit having a constant output voltage without a regulator may be obtained.

Next, a constant voltage generating method according to a second embodiment of the present invention will be described in detail. In this instance, the constant voltage generating circuits according to the first embodiment described above and FIGS. 1 to 4 may be referred to and thus, repeated descriptions will be omitted. The constant voltage generating method according to the embodiment of the present invention may be very useful for a case in which a range of a variable voltage is large, and a voltage in which LDMOS can be used is high.

FIGS. 5A and 5B are flowcharts schematically illustrating a constant voltage generating method according to another exemplary embodiment of the present invention.

Referring to FIGS. 5A and 5B, the constant voltage generating method according to an embodiment may include a voltage dropping step S100, a reference voltage and register bit outputting step S200, a comparison controlling step S330, and a constant voltage outputting step S400.

In the voltage dropping step S100 of FIGS. 5A and 5B, a variable input power is subjected to voltage drop in accordance with a preset ratio. In this instance, according to an embodiment, in the voltage dropping step S100, the variable input power is subjected to voltage drop in accordance with the preset ratio through a resistance distributor.

Next, in the reference voltage and the register bit outputting step S200 of FIGS. 5A and 5B, a band gap reference voltage and register bit are output.

In this instance, according to an embodiment, more specifically, the reference voltage and the register bit outputting step will be described. According to an embodiment, the reference voltage and register bit outputting step is not shown; however, may also include an initial step and a feedback progressing step.

The initial step indicates the reference voltage and register bit outputting step S200 which is performed before the feedback progressing step is performed in the comparison controlling step S300. In the initial step, each of a plurality of switches which are connected to a plurality of band gap resistors may be connected to a register having a register bit value, and corresponding band gap reference voltage and register bit may be output in accordance with a switching operation corresponding to the highest and lowest register bit.

Next, the feedback progressing step indicates the reference voltage and register bit outputting step S200 which is performed by performing the feedback progressing step in the comparison controlling step S300 of FIGS. 5A and 5B. In this instance, in the feedback progressing step, a switch corresponding to the next register bit is operated by the feeding back in the comparison controlling step, so that corresponding band gap reference voltage distributed by voltage distribution and the register bit are may be output.

In this instance, according to an embodiment, in the feedback progressing step, a switch is operated in accordance with a down sweep control or an up sweep control of the register bit, and therefore, corresponding next band gap reference voltage and register bit may be output.

Next, in the comparison controlling step S300 of FIGS. 5A and 5B, an input voltage which is subjected to voltage drop and the output band gap reference voltage are compared in S310. In addition, in the comparison controlling step S300 of FIGS. 5A and 5B, a corresponding step is fed back to the reference voltage and register bit outputting step S200 based on the comparison result, so that the next band gap reference voltage and register bit are output in S330, S331, and S332, or proceeds to the next step S400 to thereby generate a constant voltage in S330 and S333.

The comparison controlling step S300 will be described in detail with reference to FIGS. 5A and 5B. Referring to FIG. 5A, according to an embodiment, in the comparison controlling step S300, when the comparison result is a low signal, the corresponding step is fed back to the feedback progressing step, and performs the down sweep control of the register bit in S330 and S331. In addition, when the comparison result is a high signal, in the comparison controlling step S300, the down sweep control is stopped, and in the constant voltage outputting step, turning-on of the switch corresponding to the register bit output from the reference voltage and register bit outputting step S200 may be controlled in S330 and S333.

Another embodiment will be described with reference to FIG. 5B. In this instance, in the comparison controlling step S300, when the comparison result is the high signal, the corresponding step is fed back to the feedback progressing step, and performs an up sweep control of the register bit in S330 and S332. In addition, when the comparison result is the low signal, in the comparison controlling step S300, the down sweep control is stopped, and in the constant voltage outputting step S400, turning-on of the switch corresponding to the register bit output from the reference voltage and register bit outputting step S200 may be controlled in S330 and S333.

Subsequently, in the constant voltage outputting step S400 of FIGS. 5A and 5B, a variable input power is received by an operation of a switch corresponding to the register bit output from the reference voltage and register bit outputting step S200 in accordance with a control of the comparison controlling step S300 to thereby output a constant voltage.

The constant voltage outputting step S400 will be described in detail with reference to FIG. 3. According to an embodiment, in the constant voltage outputting step S400, the variable input power is received, and a switch corresponding to the register bit output from the reference voltage and register bit outputting step S200 is turned on in accordance with the control S333 of the comparison controlling step S300, and the variable input power is subjected to variable distribution to thereby output the constant voltage.

In this instance, referring to FIG. 3, according to an embodiment, in the constant voltage outputting step S400, the constant voltage may be output in accordance with voltage distribution of a reference resistor and a plurality of voltage dividing branch resistors connected in series to the reference resistor and connected in parallel to each other. In this instance, the switch corresponding to the register bit output from the reference voltage and register bit outputting step S200, from among the switches connected to each of the plurality of voltage dividing branch resistors, is turned on in accordance with the control S333 of the comparison controlling step S300, and then the variable input power is subjected to variable distribution to thereby output the constant voltage.

As described above, according to the embodiments of the present invention, a constant voltage may be output with respect to a variable power supply voltage by minimizing the number of other additional circuits without using a regulator.

According to an embodiment of the present invention, a circuit including a voltage distribution unit and other additional circuits is configured, so that the circuit may be effectively utilized in a system in which margins exist in power supply voltage variation, and a small amount of load current is consumed.

In addition, the constant voltage generating circuit according to an embodiment of the present invention may be very useful for a case in which a range of a variable voltage is large, and a voltage in which LDMOS can be used is high.

It is obvious that various effects directly stated according to various exemplary embodiment of the present invention may be derived by those skilled in the art from various configurations according to the exemplary embodiments of the present invention.

The accompanying drawings and the above-mentioned exemplary embodiments have been illustratively provided in order to assist in understanding of those skilled in the art to which the present invention pertains. In addition, the exemplary embodiments according to various combinations of the aforementioned configurations may be obviously implemented by those skilled in the art from the aforementioned detailed explanations. Therefore, various exemplary embodiments of the present invention may be implemented in modified forms without departing from an essential feature of the present invention. In addition, a scope of the present invention should be interpreted according to claims and includes various modifications, alterations, and equivalences made by those skilled in the art.

What is claimed is:

1. A constant voltage generating circuit, comprising:

a voltage distribution unit performing voltage drop on a variable input power in accordance with a preset ratio;

a reference voltage and register bit generation unit outputting a band gap reference voltage and a register bit in accordance with an output of a controller of a comparison control unit;

the comparison control unit comparing an output of the voltage distribution unit and the band gap reference voltage output from the reference voltage and register bit generation unit, and controlling the reference voltage and register bit generation unit or a constant voltage generation unit in accordance with the compared result; and the constant voltage generation unit receiving the variable input power by an operation of a switch corresponding to the register bit to thereby output a constant voltage, in accordance with the output of the controller of the comparison control unit.

2. The constant voltage generating circuit according to claim 1, wherein the voltage distribution unit performs the voltage drop on the variable input power in accordance with the preset ratio using a resistance distributor.

3. The constant voltage generating circuit according to claim 1, wherein the reference voltage and register bit generation unit includes:

a reference voltage generation unit which is formed with a plurality of band gap resistors connected in series, and which generates the band gap reference voltage distributed in accordance with a switch operation of a reference voltage and register bit switch unit; and the reference voltage and register bit switch unit includes a plurality of switches connected to the plurality of band gap resistors and is connected to a register having the register bit, and which outputs the register bit of the register and the band gap reference voltage, by the operation of the switch in accordance with the output of the controller of the comparison control unit.

4. The constant voltage generating circuit according to claim 3, wherein the reference voltage and register bit switch unit outputs the register bit of the register and the band gap reference voltage, by the operation of the switch corresponding to the register bit in accordance with a down sweep control or an up sweep control of a register bit of the comparison control unit.

5. The constant voltage generating circuit according to claim 1, wherein the comparison control unit includes:

a comparator comparing the input voltage dropped in the voltage distribution unit and the band gap reference voltage output from the reference voltage and register bit generation unit; and a controller performing a sweep control on a switch of the reference voltage and register bit generation unit when an output of the comparator is not a scheduled signal so that a next band gap reference voltage and a next register bit are output, and controlling the constant voltage generation unit when the output of the comparator is the scheduled signal so that the constant voltage is output.

6. The constant voltage generating circuit according to claim 3, wherein the comparison control unit includes:

a comparator comparing the input voltage dropped in the voltage distribution unit and the band gap reference voltage output from the reference voltage and register bit generation unit; and a controller performing a sweep control on a switch of the reference voltage and register bit generation unit when an output of the comparator is not a scheduled signal so that a next band gap reference voltage and a next register bit are output, and controlling the constant voltage generation unit when the output of the comparator is the scheduled signal so that the constant voltage is output.

7. The constant voltage generating circuit according to claim 5, wherein the controller performs a down sweep control of the register bit on the reference voltage and register bit generation unit when the output of the comparator is a low signal, and stops the down seep control and turns on a switch of the constant voltage generation unit corresponding to the register bit output from the reference voltage and register bit generation unit to thereby output the constant voltage when the output of the comparator is a high signal.

8. The constant voltage generating circuit according to claim 5, wherein the controller performs an up sweep control of the register bit on the reference voltage and register bit generation unit when the output of the comparator is a high signal, and stops the up sweep control and turns on a switch of the constant voltage generation unit corresponding to the register bit output from the reference voltage and register bit generation unit to thereby output the constant voltage when the output of the comparator is a low signal.

9. The constant voltage generating circuit according to claim 1, wherein the constant voltage generation unit includes:

a variable distribution switch unit which includes a plurality of switches, and in which a turn-on operation of a switch corresponding to the register bit output from the reference voltage and register bit generation unit is performed by the output of the controller of the comparison control unit; and a variable distribution unit which receives the variable input power, and performs variable distribution on the received variable input power in accordance with the turn-on operation of the variable distribution switch unit by the output of the controller of the comparison control unit to thereby output the constant voltage.

10. The constant voltage generating circuit according to claim 3, wherein the constant voltage generation unit includes:

a variable distribution switch unit which includes a plurality of switches, and in which a turn-on operation of a switch corresponding to the register bit output from the reference voltage and register bit generation unit is performed by the output of the controller of the comparison control unit; and a variable distribution unit which receives the variable input power, and performs variable distribution on the received variable input power in accordance with the turn-on operation of the variable distribution switch unit by the output of the controller of the comparison control unit to thereby output the constant voltage.

11. The constant voltage generating circuit according to claim 9, wherein the variable distribution unit includes a series connection of a reference resistor and each of a plurality of voltage dividing branch resistors connected in parallel with each other and connected in series with each switch of the variable distribution switch unit, and performs voltage distribution on the variable input power in accordance with the voltage dividing branch resistors by the turn-on operation of the variable distribution switch unit to thereby output the constant voltage.

12. A constant voltage generating method, comprising:

a voltage dropping step of performing voltage drop on a variable input power in accordance with a preset ratio;

a reference voltage and register bit outputting step of outputting a band gap reference voltage and a register bit;

a comparison controlling step of comparing an input voltage on which the voltage drop is performed and the output band gap reference voltage, and feeding back to the reference voltage and register bit outputting step in accordance with a result of the comparison to thereby control a next band gap reference voltage and register bit to be output, or proceeding to a next step to thereby control a constant voltage to be generated; and a constant voltage outputting step of receiving the variable input power by an operation of a switch corresponding to the register bit output from the reference voltage and register bit outputting step in accordance with an output of a controller used in the comparison controlling step to thereby output the constant voltage.

13. The constant voltage generating method according to claim 12, wherein the reference voltage and register bit outputting step includes:

an initial step of outputting the band gap reference voltage and register bit in accordance with an operation of a switch corresponding to a highest or a lowest register bit in a manner such that each of a plurality of switches connected to a plurality of band gap resistors is connected to a register having the register bit; and a feedback progressing step of outputting the band gap reference voltage and the register bit, in accordance with an operation of a switch corresponding to a next register bit by the feedback of the comparison controlling step.

14. The constant voltage generating method according to claim 13, wherein the feedback progressing step outputs the next band gap reference voltage and register bit by the operation of a switch in accordance with a down sweep control or an up sweep control of the register bit.

15. The constant voltage generating method according to claim 13, wherein the comparison controlling step returns to the feedback progressing step to perform a down sweep control of the register bit when the result of the comparing is a low signal, and stops the down sweep control to thereby control a turn-on operation of the switch corresponding to the register bit output from the reference voltage and register bit outputting step in the constant voltage outputting step when the result of the comparing is a high signal.

16. The constant voltage generating method according to claim 13, wherein the comparison controlling step returns to the feedback progressing step to perform an up sweep control of the register bit when the result of the comparing is a high signal, and stops the up sweep control to thereby control a turn-on operation of the switch corresponding to the register bit output from the reference voltage and register bit outputting step in the constant voltage outputting step when the result is a low signal.

17. The constant voltage generating method according to claim 12, wherein the constant voltage outputting step includes receiving the variable input power, performing variable distribution on the variable input power by turning on the switch corresponding to the register bit output from the reference voltage and register bit outputting step in accordance with the output of the controller used in the comparison controlling step, and outputting the constant voltage.

18. The constant voltage generating method according to claim 13, wherein the constant voltage outputting step includes receiving the variable input power, performing variable distribution on the variable input power by turning on the switch corresponding to the register bit output from the reference voltage and register bit outputting step in accordance with the output of the controller used in the comparison controlling step, and outputting the constant voltage.

19. The constant voltage generating method according to claim 17, wherein the constant voltage outputting step includes outputting the constant voltage in accordance with voltage distribution of a reference resistor and a plurality of voltage dividing branch resistors which are connected in series with the reference resistor and connected in parallel with each other, wherein the variable distribution on the variable input power is performed by turn-on of the switch corresponding to the register bit output from the reference voltage and register bit outputting step, from among switches connected to each of the plurality of voltage dividing branch resistors, in accordance with the output of the controller used in the comparison controlling step.

* * * * *